United States Patent [19]

Hrovatin et al.

[11] 4,441,443

[45] Apr. 10, 1984

[54] SEWING-MACHINE FRAME

[75] Inventors: Albert Hrovatin; Jozé Brezec, both of Koper, Yugoslavia

[73] Assignee: Do-Mehanotehnika, Proizvodnja in Prodaja Igrac, Kovinskih in Plasticnih Izdelkov N.Sol.O., Izola, Yugoslavia

[21] Appl. No.: 391,695

[22] Filed: Jun. 24, 1982

[30] Foreign Application Priority Data

Dec. 25, 1981 [YU] Yugoslavia ..... M485/81

[51] Int. Cl.[3] ..... D05B 73/00

[52] U.S. Cl. ..... 112/258

[58] Field of Search ..... 112/258, 259; D15/76

[56] References Cited

U.S. PATENT DOCUMENTS

| | | | |
|---|---|---|---|
| 3,420,198 | 1/1969 | Grevlich | 112/259 X |
| 3,858,954 | 1/1975 | Heherich | 112/258 X |
| 3,954,073 | 5/1976 | Varin | 112/259 |

*Primary Examiner*—Werner H. Schroeder
*Assistant Examiner*—Andrew M. Falik
*Attorney, Agent, or Firm*—Fleit, Jacobson, Cohn & Price

[57] ABSTRACT

A sewing machine is shown and described which embodies a new configuration of a toy sewing machine. Many of the features shown are of a detail previously known only to operational models.

1 Claim, 2 Drawing Figures

SEWING-MACHINE FRAME

BACKGROUND OF THE INVENTION

Functional sewing machines have been altered and manufactured as toy models for use by children for many years. The design and use of these models have generally neglected many of the operational features of the actual machines.

SUMMARY OF THE INVENTION

The object of the present invention is a sewing-machine, which differs from known objects of the same kind and is preferably embodied as a toy.

BRIEF DESCRIPTION OF THE DRAWINGS

The characteristic features and the novel features of the proposed design are in detail described on the basis of the attached drawing.

DETAILED DESCRIPTION OF THE INVENTION

Figure 1:
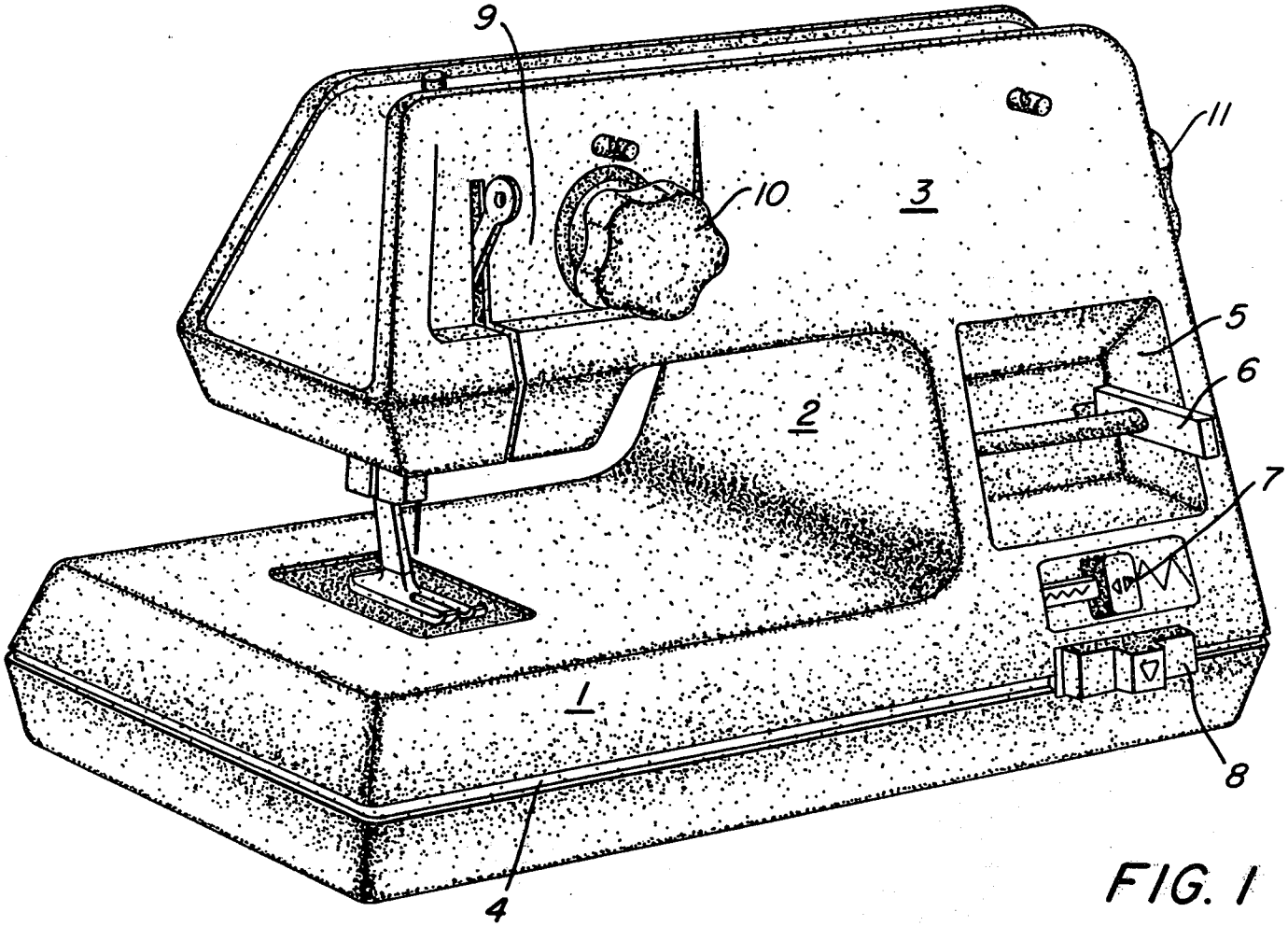
FIG. 1 shows a sewing-machine according to the proposed design, in front perspective view.
Figure 2:
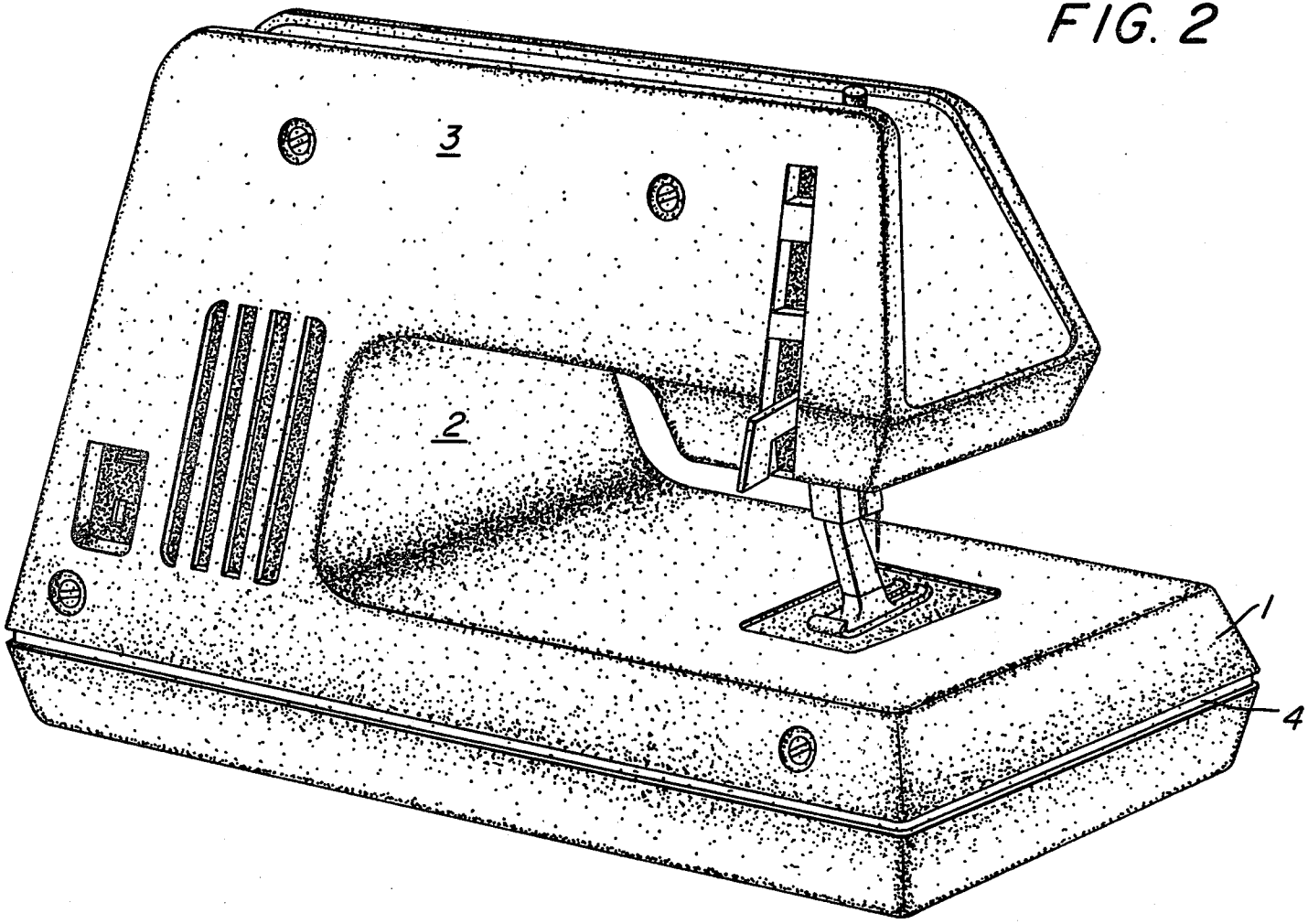
FIG. 2 shows the sewing machine according to the proposed design, in rear perspective view.

The sewing-machine is made of pedestal plate 1, pillar 2 and overhang beam 3. The basic form of the whole body is derived from a four-side truncated pyramid. The pedestal plate 1 has a rectangular shape, its side planes being convex so that the cross-section of the convexity is shaped as an isosceles triangle with a square cutout in the top, which appears in the plate 1 as a channel 4 running around the plate.

The pillar 2 descends from the pedestal plate 1 as a truncated four-side pyramid which on the front side has a prismatic hollow 5 in which is embodied a carrier 6 for a thread reel, not shown in the drawing. The carrier 6 is shaped as a lying letter T.

Under the hollow 5 there is embodied a smaller prismatically shaped button 7. In the line of the channel 4, there is embodied a button 8 shaped as an oblong rectangular plate with a convexity formed in the middle of the front side, the convexity having a shape of a prism in which is embodied a hollow with an outline of an equilateral triangle turned downwards.

The upper part of the pillar 2 extends to the overhang beam 3, which extends over the pedestal plate 1. The overhang beam 3 is shaped as an oblong truncated four-side pyramid with a smaller downwards directed truncated four-side pyramid formed on the free end on a lower side. On the front side near the free end there is embodied a shallow hollow 9, its outline having the form of a trapezoid with rounded off angles at its lower base-line. In the hollow 9 there is arranged a button 10, which has a shape of a cylinder with several coaxially running channels on the surface.

The side planes and the upper plane of the overhang beam 3 are concave, being inset from the surface, but of a generally flat configuration. On the side plane of the overhang beam 3 there is at the pillar 2 arranged a button 11, which has the same shape as the button 10, however, it is slightly larger. All edges and corners are rounded off.

We claim:

1. Sewing-machine, characterized in that the basic form of the whole body is derived from a four-sided truncated pyramid; in that a pedestal plate has a rectangular shape, its side planes being convex so that the cross-section of the convexity is shaped as an isosceles triangle with a square cutout in the top, which appears in the plate as a channel running around it; in that a pillar is embodied as a truncated four-sided pyramid which on the front side has a prismatic hollow in which is embodied a carrier of a thread reel, the carrier being shaped as a lying letter T; in that under the hollow there is embodied a smaller prismatically shaped button, thereunder being embodied a button shaped as on oblong rectangular plate with a convexity formed in the middle of the front side, the convexity having a shape of a prism in which is embodied a hollow with an outline of an equilateral triangle turned downwards; in that an overhang beam is shaped as an oblong truncated four-sided pyramid with a smaller downwards directed truncated pyramid formed on the free end on the lower side, whereby on the front side near the free end there is embodied a shallow hollow, its outline having the form of a trapezoid with rounded off angles at its lower base-line, and whereon is arranged a first button, which has a shape of a cylinder with several coaxially running channels on the surface; in that the side planes and the upper plane of the overhang beam are concave; in that on the side plane of the overhang beam there is at the pillar arranged a second button, which has the same shape as said first button, it being, however, slightly larger; and finally characterized in that all edges and corners are rounded off.

* * * * *